US006145582A

United States Patent [19]

Bolle et al.

[11] Patent Number: 6,145,582

[45] Date of Patent: Nov. 14, 2000

[54] HEAT ACCUMULATOR BLOCK FOR REGENERATED HEAT EXCHANGER

[75] Inventors: Bernd Bolle, Dorsten; Lothar Stüfchen, Haltern; Franz-Josef Hagemann; Bernd Hewing, both of Ochtrup, all of Germany

[73] Assignees: STEAG AG; 2H Kunststoff GmbH, both of Germany

[21] Appl. No.: 09/331,703

[22] PCT Filed: Dec. 16, 1997

[86] PCT No.: PCT/EP97/07016

§ 371 Date: Jun. 18, 1999

§ 102(e) Date: Jun. 18, 1999

[87] PCT Pub. No.: WO98/27394

PCT Pub. Date: Jun. 25, 1998

[30] Foreign Application Priority Data

Dec. 19, 1996 [DE] Germany ..... 196 52 999

[51] Int. Cl.[7] ..... F28D 7/02

[52] U.S. Cl. ..... 165/10; 165/8; 165/6; 165/119; 122/1 A

[58] Field of Search ..... 165/10, 8, 119, 165/5, 6; 122/1 A

[56] References Cited

U.S. PATENT DOCUMENTS

| | | | |
|---|---|---|---|
| 3,651,862 | 3/1972 | Ballinger | 165/10 |
| 4,200,441 | 4/1980 | Honmann et al. | 165/10 |
| 4,903,756 | 2/1990 | Monro | 165/8 |
| 5,836,379 | 11/1998 | Counterman | 165/10 |
| 5,899,261 | 5/1999 | Brzytwa et al. | 165/8 |
| 5,915,340 | 6/1999 | Cronin et al. | 122/1 A |
| 5,983,985 | 11/1999 | Counterman et al. | 165/8 |
| 6,068,045 | 5/2000 | Fieric et al. | 165/10 |

FOREIGN PATENT DOCUMENTS

| | | |
|---|---|---|
| 32 36 054 | 9/1982 | Germany . |
| 32 40 598 | 11/1982 | Germany . |
| 34 24 159 | 6/1984 | Germany . |
| 34 36 802 | 10/1984 | Germany . |
| 62-258894 | 11/1987 | Japan . |
| WO 88/06708 | 9/1988 | WIPO . |

*Primary Examiner*—Ira S. Lazarus
*Assistant Examiner*—Terrell McKinnon
*Attorney, Agent, or Firm*—Robert W. Becker & Associates

[57] ABSTRACT

A heat accumulator block for regenerative heat exchangers has a heat exchanger of a plurality of heat exchanger plates arranged substantially parallel to one another for formation of flow channels. A dirt collector is arranged upstream of a side of the heat exchanger exposed to an inflowing cold medium. The dirt collector consists of a plurality of protective plates which are arranged substantially parallel to the heat exchanger plates and have a plurality of spacers. The spacers are arranged between neighboring plates and connect the neighboring plates to one another. The spacers are positioned at a spacing to those edges of the protective plates which are exposed to an inflowing cold medium.

16 Claims, 4 Drawing Sheets

HEAT ACCUMULATOR BLOCK FOR REGENERATED HEAT EXCHANGER

BACKGROUND OF THE INVENTION

The invention relates to a heat accumulator block for regenerative heat exchangers with a plurality of heat exchanger plates which, for formation of flow channels, substantially extend parallel to one another.

Heat accumulator blocks of this kind are, in general, pie-shaped and together form a rotor which for one revolution passes through two zones. In the first zone, it is subjected to a hot medium which releases heat to the heat exchanger plates. In the second zone a cold medium flows therethrough to which the stored heat is released. The heat exchanger plates are comprised, in general, of steel and, for increasing their corrosion resistance, are lined with enamel.

Regenerative heat exchangers serve preferably to transfer heat from a hot gas flow to a cold gas flow. An important field is flue gas scrubbing, for example, in power plants and incinerators, whereby the flue gas is scrubbed in a flue gas desulfurization device. Before entering it, it is cooled whereby its heat is transferred onto the regenerative heat exchanger. Subsequently, reheating takes place by using the heat stored within the heat exchanger.

When cooling, the temperature, in general falls below the dew point of the condensible materials contained in the flue gas.

They will precipitate on the heat exchanger plates at the heat accumulator blocks and form deposits. Furthermore, the cold gas coming from the flue gas desulfurization device is, to a certain extent, loaded with liquid droplets and solid particles which will also deposit on the plates and which will worsen the deposit effect.

The channels in the heat accumulator blocks thus will become clogged to an increasing extent and thus require regular and rather frequent cleaning. This is done by exposure to a stream of air, water, or steam. For each cleaning process, a certain amount of freshly formed deposits will remain adhered to the plates so that the clogging of the channels is only delayed by the cleaning processes. As soon as the flow channels can no longer be reached by the cleaning processes, an exchange of the heat accumulator blocks must be performed.

It is an object of the invention to extend the service life of heat accumulator blocks.

SUMMARY OF THE INVENTION

As a solution to this object, the aforementioned heat accumulator block is characterized in that:

- a dirt collector is arranged upstream of the heat exchanger plates at the side exposed to the cold medium,
- the dirt collector comprises a plurality of protective plates which extend substantially parallel to the heat exchanger plates,
- a plurality of spacers is provided which are positioned between neighboring protective plates and connect them to one another by fastening means, and
- the spacers are arranged at a spacing from the edges of the protective plates where the cold medium enters.

The invention is based on the discovery that the deposits are primarily formed at the side of the heat accumulator blocks exposed to the cold medium whereby they extend substantially only to a relative short length into the flow channels. Only in this area the temperature of the hot medium falls below the dew point. With regard to the cold medium, this is the entry area with the highest degree of soiling. Here the inventive dirt collector is arranged. Its protective plates have substantially no contribution with regards to heat storage and heat transfer. It was found that the temperature difference at the protective plates is in the magnitude of ±1K. The protective plates thus only provide depositing surfaces.

Surprisingly, this extremely simple measure, i.e., to eliminate spacers within the entry area of the protective plates, is sufficient to delay the formation of deposits greatly so that the time period between the still required cleaning processes is multiplied. Accordingly, the time period between the also still required exchanges is also multiplied whereby this, however, in most cases only refers to the dirt collector.

An additional advantageous effect results in that the edges of the protective plates that are not supported relative to one another thus provide a certain degree of freedom of movement. They therefore can experience vibration, especially when subjected to the cleaning medium, so that chipping of the deposits is greatly enhanced.

Finally, the cleaning medium impinges with reduced impact onto the spacers so that the received forces have a reduced tendency to produce cracks at the fastening location.

Preferably, the protective plates are made of elastic deformable plastic material, especially polypropylene, with a thickness of 1 mm because this material is resistant to chemicals and, in contrast to, e.g., ceramic material, is not related to the material of the deposits. Furthermore, due to its elastic deformability, it favors chipping of the deposits under the effect of vibrations. Furthermore, mounting stress and heat expansion can be compensated without risk of crack formation.

These properties can be further enhanced by providing the protective plates with a preferably wave-shaped profiling having ribs extending substantially in the direction of the flow channels. Heat expansion under these conditions even have a favorable effect in that the resulting movement further enhances chipping of the deposits.

Advantageously, the spacers are small-surface-area bulges of the protective plates. They are formed during manufacture of the protective plates, and, in this manner, allow for an economic manufacture of the dirt collector. Furthermore, only relatively small obstacles are formed in the flow channels.

As an especially advantageous measure it is suggested that the bulges forming the spacers are projections and corresponding depressions of the plate profiling. Each spacer thus is comprised of a projection and a corresponding depression of the neighboring plate whereby between the projection and the depression the fastening means are effective. The fastening means can be of any desired design, for example, in the form of rivets or screws. It is also possible to provide snap connections. Also possible are material connections realized by welding or the use of adhesives.

An important development of the invention suggests that the projections and corresponding depressions of the plate profiling are arranged on a grid which provides for correspondence between neighboring protective plates by rotation of one plate relative to the other by 180° in the plate plane. In this manner only one single plate structure is required. The plates are stacked in alternating orientation and are connected by forming the spacers.

A preferred grid is realized by providing one projection and one depression adjacent to one another in the neighboring ribs of the plate profiling. Thus, a very stable construction of the plate package with formation of favorable flow conditions in the channels results, whereby there are no problems in regard to positioning the spacers with sufficient spacing from the inflow plate edges.

In an advantageous embodiment of the invention, it is suggested that the protective plates, at least in the area of the edges subjected to the cold medium, have cone-shaped projections having a height that substantially corresponds to the spacing between neighboring protective plates. The elastic plates of the dirt collector are leafed through during cleaning like a stack of cards. When one protective plate is no longer exposed to the cleaning medium, it springs back into its initial position whereby it impacts with its projections on the neighboring protective plates. These impacts additionally enhance the chipping of the deposits.

The invention provides furthermore a dirt collector for heat accumulator blocks of regenerative heat exchanges having features as disclosed in patent claims 9 through 16.

BRIEF DESCRIPTION OF THE DRAWINGS

The invention will be disclosed in detail in the following with the aid of preferred embodiments in connection with the attached drawing. The drawing shows in.

DESCRIPTION OF PREFERRED EMBODIMENTS

Figure 1:
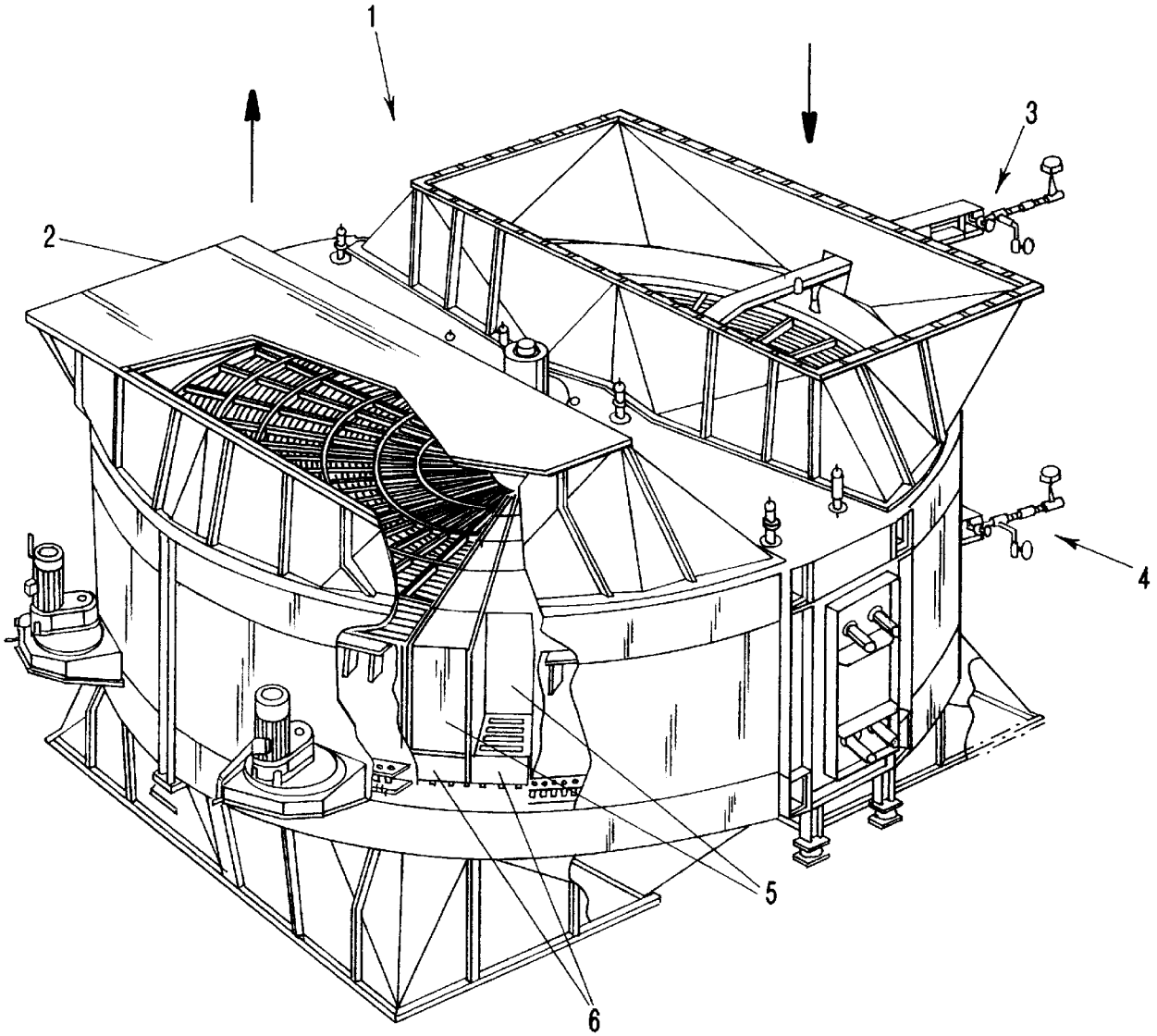
FIG. 1 a partially sectioned perspective view of the regenerative heat exchanger.

FIG. 1 shows a regenerative heat exchanger 1 which is correlated to a non-represented flue gas desulferization device. The heat exchanger 1 has a rotor 2 which with each revolution will pass through two zones. In the zone to the right, raw gas will flow through it on its way to the desulferization device. The raw gas at the hot side has a temperature of approximately 130° and will transfer a portion of its heat energy onto the rotor 2. It exits the heat exchanger at a temperature of approximately 90° C.

In the flue gas desuferization device, further cooling to 50° C. takes place. At this temperature, the clean gas will flow into the zone to the left, will flow through the rotor, and then take up a portion of the heat energy stored in the rotor 2. It exits the heat exchanger at a temperature of approximately 90° C.

Cleaning devices 3 and 4 are provided to clean the rotor periodically.

The rotor is comprised of a plurality of pie-shaped heat accumulator blocks 5 which at the cold gas side are provided with a dirt collector 6. Each heat accumulator block has a plurality of heat exchanger plates which are comprised of enameled sheet steel and which are able to receive heat, to store it, and to release it.

Figure 2:
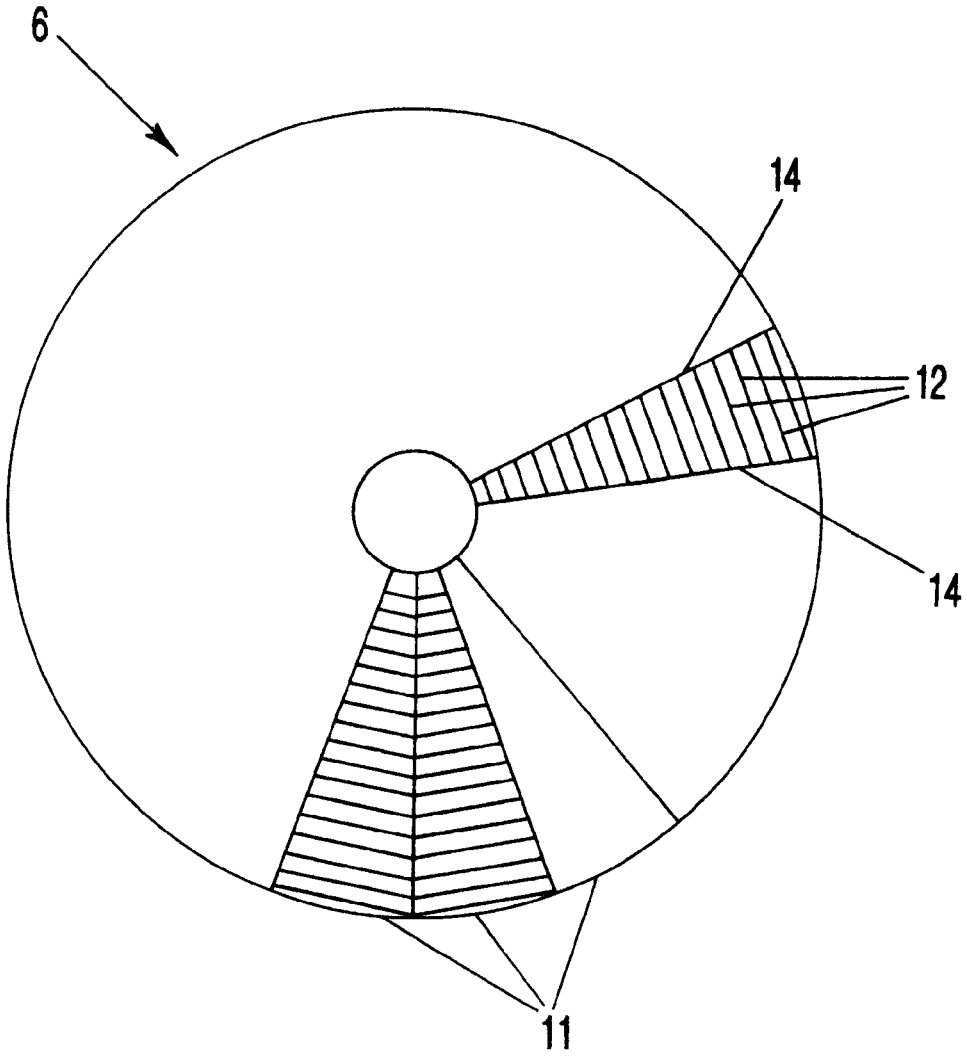
FIG. 2 a dirt collector in contour.

The dirt collector 6 is comprised, as shown in FIG. 2, of pie-shaped blocks 11 whereby each of these blocks is comprised of a plurality of protector plates 12. They are connected with their lateral edges 13 (FIG. 3) to a securing device 14 and form flow channel which extend perpendicularly to the drawing plane of FIG. 2.

The protective plates 12 are spaced to one another by spacers 15 (FIG. 4) and are connected to form a plate stack. Fastening means can be, for example, adhesive connections.

Each spacer 15 is comprised of a projection 16 at one protective plate and a depression 17 of the neighboring protective plate. The projections 16 and the depressions 17 are arranged in pairs adjacent to one another (FIG. 3).

Figure 4:
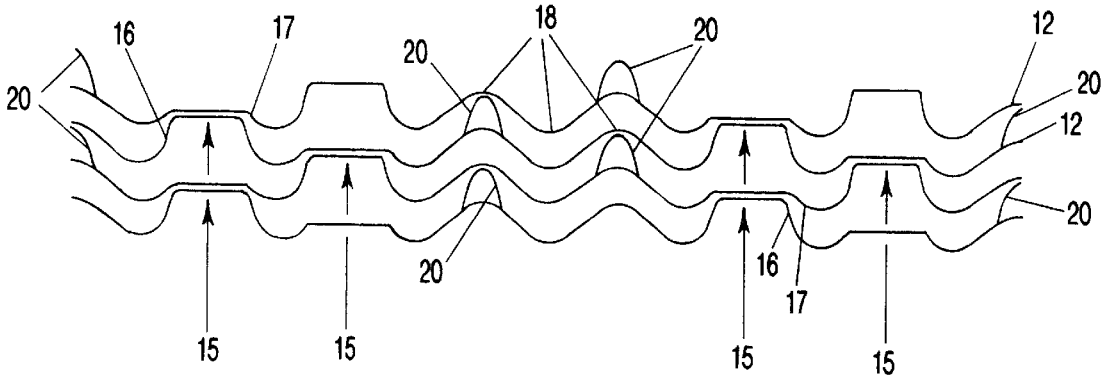
FIG. 4 at an enlarged scale along the line VI—VI of FIG. 3.

The protective plates 12 are comprised of elastically deformable plastic, i.e., of polypropylene, and can be produced without problems in the shown design. It is possible to employ one and the same grid. As is shown in FIG. 4, neighboring protective plates 12 have the same shape but alternating orientation whereby neighboring protective plates are rotated by 180° relative to one another. Furthermore, the protective plates have a profiling with ribs 18 extending parallel to the side edges 13.

Figure 3:
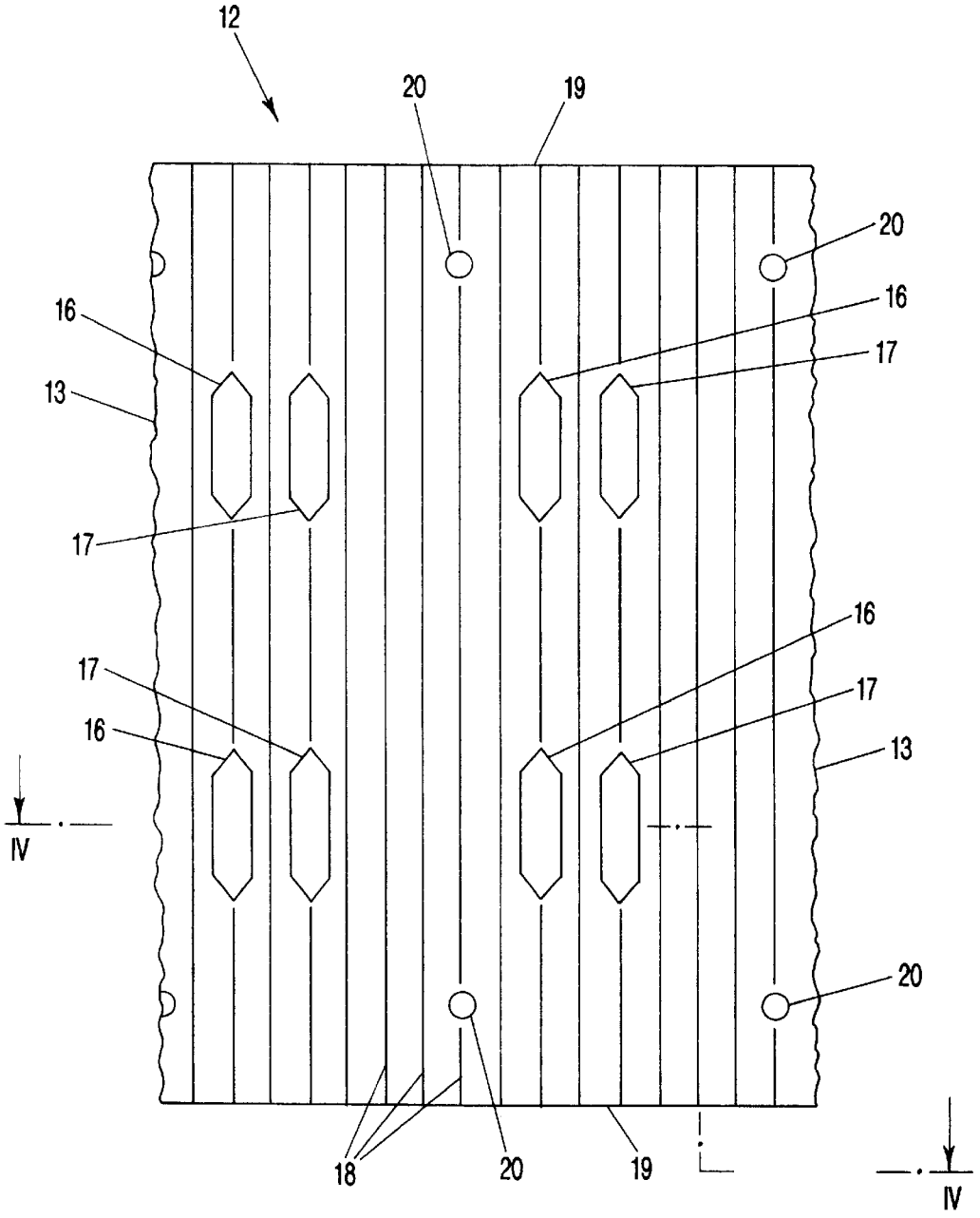
FIG. 3 a plan view onto the protective stack.

As can be seen in FIG. 3, the projections 16 and the depression 17 which form the spacers 15, are positioned at a spacing from the end face edges 19 of the protective plates 12. In the area of these edges the formation of deposits occurs, in the present case, however, in greatly diminished amounts because the spacers 15 do not extend into this area. When the required cleaning processes are performed, the spacer are thus also subjected only to reduced loads.

Since the protective plates are comprised of elastic deformable polypropylene having a thickness of 1 mm, they can enhance the chipping of the deposits by vibrations and movement due to heat expansion. They also compensate the mounting stress.

For example, it is sufficient to clean the dirt collector 6 by the device 4 once a day with compressed air of approximately 2 bar. Due to the increased chipping action of the deposits, a further cleaning by a water jet of approximately 40 to 100 bar, which had to be performed every four weeks in the past, must only be performed at the earliest after five months.

An exchange of the dirt collector 6 is required only every third year and can be performed very inexpensively.

Since the deposits will form slowly at the dirt collectors, the flow channels remain always open. Accordingly, in the rotor 2 there are no areas which are shielded from the cold gas flowing therethrough and are subjected to a greater extent to corrosion. As a result, the service life of the heat exchanger plates is increased to a period of approximately 10 years. A considerable cost reduction results.

According to FIG. 4, the protective plates 12 in the area of its edges exposed to the cold medium are provided with cone-shaped projections 20. Upon vibration of the protective plates, these projections will impact on neighboring protective plates and thus contribute to the chipping of the deposits.

In the context of the invention further developments are possible. For example, the profiling of the protective plates can be different from the one shown in FIG. 4. Also possible are, of course, planar protective plates. Furthermore, it is possible to provide different embodiments of spacers. For example, separate components can be provided. It is essential that the edge area of the protective plates at the end faces at least in the end flow of the end cold medium be kept free of spacers. When the spacers, as shown, are in form of bulges, the shape can be selected such the bulges of one protective plate cooperate with normal surface portions of neighboring protective plates. As a fastening means spot welding is possible.

It is also possible to design the heat exchanger plates identical to the protective plates.

The present invention is, of course, in no way restricted to the specific disclosure of the specification and drawings, but also encompasses any modifications within the scope of the appended claims.

What is claimed is:

1. A heat accumulator block for regenerative heat exchangers; said heat accumulator block comprising:

a heat exchanger comprised of a plurality of heat exchanger plates arranged substantially parallel to one another and defining flow channels therebetween, said heat exchanger having a side exposed to an inflowing cold medium;

a dirt collector arranged upstream of said side of said heat exchanger exposed to said inflowing cold medium, said dirt collector being comprised of a plurality of protective plates arranged substantially parallel to said heat exchanger plates;

spacers arranged between neighboring plates of said protective plates for spacing said neighboring plates relative to one another;

fastening means for connecting said neighboring plates to one another via said spacers; and said spacers positioned at a spacing to edges of said protective plates exposed to said inflowing cold medium.

2. A heat accumulator block according to claim 1, wherein said protective plates consist of an elastic deformable plastic material and have a thickness of approximately 1 mm.

3. A heat accumulator block according to claim 1, wherein said protective plates have a wave-shaped profiling forming ribs, wherein said ribs extend substantially in a direction of said flow channels.

4. A heat accumulator block according to claim 1, wherein said spacers are local bulges of said protective plates.

5. A heat accumulator block according to claim 4, wherein said bulges are matching projections and depressions of said profiling of said protective plates.

6. A heat accumulator block according to claim 5, wherein said matching projections and depressions of said profiling of said protective plates are arranged on an imaginary grid and wherein neighboring ones of said protective plates, by rotating one of said protective plates relative to another one of said protective plates in the plane of said protective plates by 180°, are brought into a position in which said matching projections and depressions are aligned with one another.

7. A heat accumulator block according to claim 6, wherein said matching projections and depressions are arranged on each one of said protective plates adjacent to one another in neighboring ribs of said profiling of said protective plates.

8. A heat accumulator block according to claim 1, wherein said protective plates have conical projections at least in an area of said edges exposed to said inflowing cold medium, wherein said conical projections have a height that is substantially identical to said spacing between said neighboring plates.

9. A dirt collector for heat accumulator blocks for regenerative heat exchangers comprising:

a plurality of protective plates extending substantially parallel to one another for formation of flow channels, wherein each of said protective plates has an edge exposed to an inflowing cold medium;

spacers arranged between neighboring plates of said protective plates for spacing said neighboring plates relative to one another;

fastening means for connecting said neighboring plates to one another via said spacers; and said spacers positioned at a spacing to edges of said protective plates exposed to said inflowing cold medium.

10. A dirt collector according to claim 9, wherein said protective plates consist of an elastic deformable plastic material and have a thickness of approximately 1 mm.

11. A dirt collector according to claim 9, wherein said protective plates have a wave-shaped profiling having ribs extending substantially in a direction of said flow channels.

12. A dirt collector according to claim 9, wherein said spacers are local bulges of said protective plates.

13. A dirt collector according to claim 12, wherein said bulges are matching projections and depressions of said profiling of said protective plates.

14. A dirt collector according to claim 13, wherein said matching projections and depressions of said profiling of said protective plates are arranged on an imaginary grid and wherein neighboring ones of said protective plates, by rotating one of said protective plates relative to another one of said protective plates in the plane of said protective plates by 180°, are brought into a position in which said matching projections and depressions are aligned with one another.

15. A dirt collector according to claim 14, wherein each of said projections has arranged adjacent thereto one depression in each one of neighboring ribs of said profiling of said protective plates.

16. A dirt collector according to claim 9, wherein said protective plates have conical projections at least in an area of said edges subjected to said inflowing cold medium, whereby said projections have a height substantially identical to said spacing between said neighboring protective plates.

* * * * *